United States Patent [19]

Sanford et al.

[11] 4,172,811

[45] Oct. 30, 1979

[54] PROCESS OF TREATING BITUMINOUS SANDS CONVEYOR BELT WITH RELEASE AGENT

[75] Inventors: Emerson Sanford, Edmonton; Robert Shaw, Leduc, both of Canada

[73] Assignees: Petro-Canada Exploration Inc., Calgary; Her Majesty the Queen in right of the Province of Alberta, Government of the Province of Alberta, Department of Energy and Natural Resources, Alberta Syncrude Equity, Edmonton; Ontario Energy Corporation; Imperial Oil Limited, both of Toronto; Canada-Cities Service, Ltd., Calgary; Gulf Oil Canada Limited, Toronto, all of Canada

[21] Appl. No.: 847,483

[22] Filed: Nov. 1, 1977

[51] Int. Cl.[2] ..... C09K 3/00

[52] U.S. Cl. ..... 208/11 LE; 106/2; 198/500; 427/401

[58] Field of Search ..... 427/300, 401; 106/2; 260/29.2 M; 252/61; 198/500; 208/11 LE

[56] References Cited

U.S. PATENT DOCUMENTS

| | | | |
|---|---|---|---|
| 2,985,544 | 5/1961 | de Monterey | 260/29.2 M |
| 3,529,868 | 9/1970 | Hogg | 198/500 |

FOREIGN PATENT DOCUMENTS

| | | | |
|---|---|---|---|
| 760442 | of 1956 | United Kingdom | 106/2 |

*Primary Examiner*—Evan K. Lawrence
*Attorney, Agent, or Firm*—Ernest Peter Johnson

[57] ABSTRACT

A process for treating a conveyor belt carrying bituminous sands with a release agent comprises: applying to the sands-bearing surface of the belt, prior to deposition of the bituminous sands, a water-based emulsion having as the disperse phase a silicone fluid having short hydroxyl-terminated polymer chains and a viscosity on the order of 100 centistokes; unloading the sands from the belt; and recovering the bitumen from the sands using a hot water extraction step. The emulsion acts as a release agent which effects clean separation of the sands from the belt surface during unloading and does not deleteriously affect the primary bitumen recovery in the extraction step.

3 Claims, No Drawings

PROCESS OF TREATING BITUMINOUS SANDS CONVEYOR BELT WITH RELEASE AGENT

BACKGROUND OF THE INVENTION

This invention relates to a method which comprises treating the load-bearing surface of the endless belt of a conveyor system with a release agent which is operative to cause bituminous sands subsequently deposited on the belt to separate cleanly therefrom when the belt rounds the end roller of the system.

The invention finds application with respect to a conveyor belt of nitrile or other rubber composition used to convey bituminous sands from a storage bin to a hot water process extraction circuit for recovering bitumen from the sands.

Bituminous sands, when dropped onto a conveyor belt from a height of several feet, tend to adhere to the belt surface when it rounds the end roller. Some of the adhering sands remain attached to the belt and build up on it to form an uneven load thereon. Other portions of the sands drop off the belt as it returns to the starting point of the system. To give some idea of the magnitude of this latter problem, in the 125,000 barrels of bitumen produced per day facility being constructed by the assignees of this invention, it is estimated that, in the absence of a suitable release agent, a deposit of tar sand 17 feet high would be generated beneath the conveyor belt each day. Indeed, provision has been made to permit mechanical shovels to drive beneath the conveyor belt to remove this material.

Out of doors, the problem has been solved by applying a liquid hydrocarbon, such as diesel fuel, to the belt surface before the sands are deposited thereon. However, this prior art belt release agent cannot be used on the conveyor belt connecting the storage bin and the conditioning drum in a hot water process extraction plant, as the belt is housed and the danger of fire or an explosion is too great.

In seeking a release agent for use on this belt, a set of criteria which the agent must satisfy has been developed. More particularly, the release agent must:

(a) when applied to the belt in moderate volume, effectively cause the sands to release from the belt surface when it is unloading at the end roller;

(b) be non-flammable;

(c) not be harmful to the hot water extraction process;

(d) not be harmful to the conveyor belt material nor render repair difficult should damage occur to the belt; and (e) be non-toxic and non-corrosive.

SUMMARY OF THE INVENTION

In accordance with the invention, it has been found that an emulsion of a certain class of silicone fluid dispersed in water, when spread over the load-bearing surface of a conveyor belt which is to transport bituminous sands, is a satisfactory release agent for use on the belt. Preferably the emulsion should contain at least 1000, and most preferably about 5,000, parts per million of water of the pure silicone fluid. It has been further observed however, that the surface of the conveyor retains much of the silicone so that after a short time the surface becomes conditioned, with the result that lower concentrations of the emulsion may be used.

Although silicone fluids of various types, when used as the disperse phase in water-based emulsions, are effective release agents, most are ruled out because their presence in the hot water extraction process is deleterious to that process. Satisfactory silicone fluids are characterized by the following:

(a) short polymer chain, such that the viscosity of the fluid is preferably around 100 centistokes; and (b) polymer chains terminated with hydroxyl groups.

Two such silicone emulsions are Dow Corning ®347, marketed by Dow Corning Ltd., Downsview, Ontario, and L-900, marketed by Union Carbide ®Canada Ltd., Calgary, Alberta.

Broadly stated, the invention is an improvement of the process wherein bituminous sands are deposited on and transported by an endless conveyor belt to its end where the sands are unloaded as the belt rounds the end roller. The improvement comprises treating the sands-bearing surface of the belt with a water-based emulsion, having as the dispersed phase a silicone fluid having short polymer chains which are hydroxyl terminated, prior to depositing the bituminous sands thereon, to provide a release agent which is operative to effect clean separation of the sands from the surface during the unloading operation.

DESCRIPTION OF THE PREFERRED EMBODIMENT

The invention has been developed by subjecting a broad range of compounds to one or both of two tests, namely: (1) a tar sand release efficiency test; and (2) a test to determine whether the use of the compound would have a seriously deleterious effect on the hot water extraction.

The test apparatus for release efficiency comprised a 15 ton punch press assembly. The original die set was replaced with a spring-loaded adapter designed to accommodate belting samples. A number of $6\times6\times\frac{1}{8}$ inch samples of Goodyear ®Rubber Company B3835 neoprene belt surfacing material were used for testing. Each sample or block of belt material was fastened in place on the adapter by means of a recessed retaining clamp to provide an exposed area of 25 sq. in. Activation of the punch press trigger mechanism forced the belt sample downward onto a tray of bituminous sands directly beneath. By maintaining a consistent depth of sands in the tray, pressure exerted was regulated by the spring tension in the adapter. Preliminary testing yielded optimum reproducibility of results at 8.8 psi with a total of nine impacts. Lateral movement of the tray allowed three repeated stamps over each of three locations on the sands bed.

The tray was filled with homogenized bituminous sands to a depth of 1.5 inches and levelled by guiding a straight edge along its rim. Compressed sand was discarded after each test and replenished with freshly chopped material.

Precoat materials requiring dissolution in an aqueous media were applied in aerosol form until the entire belt surface was wetted.

Tests were conducted at ambient room temperature. Belt samples were weighed before and after impacts. Values for weights of bituminous sand adhering were compared to blank determinations (employing untreated belt samples) and expressed as a release efficiency.

The effect on hot water extraction of release agents which were successful in the release efficiency test was tested in a laboratory-scale batch extraction apparatus.

This apparatus had been used for other studies for application at the commercial level. Bituminous sand was extracted without, and in the presence of, the compounds or formulations proposed for use as released agents.

The extraction apparatus comprised a 2 liter capacity stainless steel vessel jacketed in a steel shroud to allow passage of heating water between the vessel and jacket. The vessel was fitted with a driven impellor for stirring the vessel contents. Bituminous sands and belt release agent were introduced together with slurry water into the vessel. This mixture was stirred therein for a period of time; then additional flood water was added and the flotation was carried out. Following are the details of operation.

| Composition of Mixture: | | Grams |
|---|---|---|
| bituminous sands | | 500 |
| hot water (at 82° C.) | - slurry | 145 |
| | - flood | 955 |
| belt release agent | | ≃0.10 |
| Impellor r.p.m. | - 600 | |
| Retention time | - 10 min. slurry | |
| | - 10 min. primary flotation | |
| Temperature within vessel | - 82° C. | |

Froth was recovered by skimming and analyzed for bitumen, water and solids by Soxhlet extraction with toluene.

Following are results obtained during these tests with reference to silicone emulsions:

$$\% \text{ Release Efficiency} = 100 - \frac{\text{Tar sand adhering in presence of release agent} \times 100}{\text{Tar Sand adhering without release agent}}$$

TABLE I

| Non-ionic silicone emulsion | Concentration in water ppm | Belt Release Efficiency: Release Efficiency: Medium Grade Tar Sand (11.51 wt. % bitumen) | Rich Grade Tar Sand (13.68 wt. % bitumen) |
|---|---|---|---|
| Distilled water | | | 49.86 |
| Dow Corning 347 (60% Silicone fluid) | 1000 | 29.78 | 72.52 |
| | 5000 | 82.36 | 91.46 |
| | 10000 | 97.90 | 86.97 |
| Dow Corning 37 (35% Silicone fluid) | 5000 | 96.14 | 92.69 |
| Dow Corning HV-490 | 15000 | 98.24 | — |
| Dow Corning 36 | 5000 | 94.32 | 91.83 |

TABLE II

Effect on the Hot Water Extraction Process

| Tar Sand Analysis Additive silicone emulsion | Bitumen 11.1 wt. % Water 4.9 Mineral Solids 83.9 ppm on tar sand basis | Bitumen Recovery (wt. %) Primary Froth |
|---|---|---|
| None | 0 | 70.8 |
| non-ionic short chain length polymer hydroxyl terminated (Dow Corning 347) | 200 | 68.1 |
| essentially non-ionic, 10,000 cs 35% solids made from DC-200 fluid. (Dow Corning 37) | 200 | 26.7 |
| essentially non-ionic, 35% solids, stable to freeze-thaw made from DC-200 fluid less than 10,000 cs. (Dow Corning 36) | 200 | 32.8 |
| anionic, 35% solids, 100,000 cs, made from DC-200 fluid. (Dow Corning HV - 490) | 0.2 | 43.0 |
| | 2 | 42.4 |
| | 20 | 27.1 |
| Dow Corning 347, chain length increased with catalyst 164** | 200 | 11.08 |

** By using a suitable catalyst, such as Dow Corning® Catalyst 164 the polymer chain length of Dow Corning® 347 silicone emulsion was increased. However by so doing, the number of hydroxyl groups decreased and the silicone emulsion gradually became deleterious to the hot water extraction process.

The embodiments of the invention in which an exclusive property or privilege is claimed are defined as follows:

1. In a process wherein bituminous sands are deposited on and transported by an endless conveyor belt to its end where the sands are unloaded as the belt rounds the end roller, said process further including recovering bitumen from the bituminous sands by means of a hot water extraction step, the improvement comprising:

treating the sands-bearing surface of the belt, prior to depositing the bituminous sands thereon, with a water-based emulsion having as the disperse phase a silicone fluid having short polymer chains such that the silicone fluid viscosity is on the order of 100 centistokes, said polymer chains being hydroxyl terminated, to provide a release agent which is operative to effect clean separation of the sands from the surface during the unloading operation and which does not substantially and deleteriously affect the primary bitumen recovery in the extraction step.

2. The improvement as set forth in claim 1 wherein the emulsion contains at least 1000 parts of silicone fluid per million parts of water.

3. The improvement as set forth in claim1 wherein the emulsion contains about 5000 parts of silicone emulsion per million parts of water.

* * * * *